US009093760B2

(12) United States Patent
Weikle et al.

(10) Patent No.: US 9,093,760 B2
(45) Date of Patent: Jul. 28, 2015

(54) TELECOMMUNICATIONS WIRING TERMINATION BLOCK

(75) Inventors: Owen B. Weikle, Hutchinson, MN (US); Ronald L. Fredrickson, Hector, MN (US); Nicholas B. Larsson, Blomkest, MN (US); Brett Utesch, Olivia, MN (US); George I. Wakileh, Batavia, IL (US)

(73) Assignee: Communication Systems, Inc., Hector, MN (US)

( * ) Notice: Subject to any disclaimer, the term of this patent is extended or adjusted under 35 U.S.C. 154(b) by 93 days.

(21) Appl. No.: 14/113,892

(22) PCT Filed: Apr. 26, 2012

(86) PCT No.: PCT/US2012/035201

§ 371 (c)(1),
(2), (4) Date: Dec. 6, 2013

(87) PCT Pub. No.: WO2012/173702

PCT Pub. Date: Dec. 20, 2012

(65) Prior Publication Data

US 2014/0094069 A1 Apr. 3, 2014

Related U.S. Application Data

(60) Provisional application No. 61/479,113, filed on Apr. 26, 2011.

(51) Int. Cl.

| | |
|---|---|
| ***H01R 9/22*** | (2006.01) |
| ***H01R 4/24*** | (2006.01) |
| *H01R 9/24* | (2006.01) |

(52) U.S. Cl.

CPC ..... *H01R 4/24* (2013.01); *H01R 4/2433* (2013.01); *H01R 9/24* (2013.01)

(58) Field of Classification Search

CPC ..... H01R 4/24; H01R 4/2433; H01R 9/24
USPC ..... 439/709, 441, 403, 404, 409, 410
See application file for complete search history.

(56) References Cited

U.S. PATENT DOCUMENTS 5,653,608 A 8/1997 Saligny
5,860,829 A * 1/1999 Hower et al. ..... 439/417

(Continued)

OTHER PUBLICATIONS

International Search Report from corresponding PCT Application No. PCT/US2012/035201 mailed Aug. 3, 2012 (4 pages).

(Continued)

*Primary Examiner* — Javaid Nasri
(74) *Attorney, Agent, or Firm* — Westman, Champlin & Koehler, P.A.

(57) ABSTRACT

A device that replaces the traditional 66 block device has improved pair-to-pair wire isolation to facilitate the transmission of both POTS and xDSL signals. The device includes a non-conductive lower member and a non-conductive upper member that retain a plurality of pairs of electrically conductive stampings therebetween. Each of the pairs of stampings is positioned to be in electric contact with each other such that a signal can be transmitted from one stamping to the other stamping. The stampings are utilized to electrically connect external telecommunication wires to internal telecommunications wires. Each toggle of a plurality of toggles is independently and pivotally connected to the upper member and includes a through bore for accepting an end of a wire that is accessible to an installer when the toggle is in an open, un-terminated position. Each of the toggles are movable from the open, un-terminated position to a closed, terminated position.

20 Claims, 11 Drawing Sheets

(56) References Cited

U.S. PATENT DOCUMENTS

| | | | |
|---|---|---|---|
| 6,077,105 | A | 6/2000 | Jochen et al. |
| 6,093,049 | A | 7/2000 | Daoud |
| 6,796,855 | B2 | 9/2004 | Fricke et al. |
| 7,223,115 | B2 | 5/2007 | Hashim et al. |
| 7,534,149 | B2 | 5/2009 | Williams et al. |
| 2007/0230452 | A1 | 10/2007 | Hough et al. |

OTHER PUBLICATIONS

Form PCT/ISA/237, Written Opinion of the International Searching Authority, issued Aug. 3, 2012, 7 pages.

Office Action issued in corresponding Mexican Patent Application No. MX/a/2013/012166, from the Mexican Institute of Industrial Property (IMPI) dated Feb. 10, 2015 (5 pages).

* cited by examiner

TELECOMMUNICATIONS WIRING TERMINATION BLOCK

CROSS-REFERENCE TO RELATED APPLICATION(S)

This is a U.S. national phase application of International Patent Application No. PCT/US/2012/035201, having an international filing date of Apr. 26, 2012; which claims priority to U.S. Provisional Patent Application No. 61/479,113, filed on Apr. 26, 2011, the disclosures of which are incorporated by reference in their entireties.

BACKGROUND

The discussion below is merely provided for general background information and is not intended to be used as an aid in determining the scope of the claimed subject matter.

The present disclosure relates to a device for terminating multi-pair telecommunications cables. More particularly, the present disclosure relates to a device for terminating multi-pair telecommunications cables that provides improved pair-to-pair wire isolation along with being capable of being installed without any customized or specialized tools.

The telecommunications industry has been using 66 block devices for terminating multi-pair telecommunications cables, including 25 pair and 50 pair cables, for many years. The 66 block devices are typically utilized to connect and isolate the external telecommunications wiring from the internal telecommunications wiring of a building. The 66 block devices for a building are typically located at or in a wiring closet such that all of the termination locations for the external telecommunications wiring and the internal communication wiring are in one location.

The 66 block devices are also utilized within isolated, stand alone enclosures at some facilities, such as at a plant or production facility. The isolated, stand alone enclosures are utilized for the same purposes as the wiring closet of a building, namely, to provide a single location for terminating the external telecommunications wiring and for connecting the telecommunications wiring for the facility.

The 66 block devices typically require a specialized punch down tool to install the pairs of telecommunications wires to the device. The punch down tool is typically customized to work with termination blocks produced by a particular manufacturer. As such, if an installer wants to utilize multiple suppliers of the 66 block devices, the installer must carry each of the 66 block device manufacturer's punch down tool, which can be costly, cumbersome and inefficient.

Traditionally, the multi-pair cables were only for voice signals, otherwise known as plain old telephone service (POTS). However, with technological advances, like xDSL, it is now possible to deliver both high speed data (xDSL) and POTS over the same twisted pairs. While the standard 66 block devices functioned exceptionally well with POTS signals, the standard 66 block devices do not function well with the high speed data signals due to poor pair-to-pair wire isolation.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

An aspect of the disclosure relates to a device that replaces the traditional 66 block device which has improved pair-to-pair wire isolation to facilitate the transmission of both POTS and xDSL signals. The device includes a non-conductive lower member and a non-conductive upper member that retain a plurality of pairs of electrically conductive stampings therebetween. Each of the pairs of stampings is positioned to be in conductive contact with each other such that a signal can be transmitted from one stamping to the other stamping. The stampings are utilized to electrically connect external telecommunication wires to internal telecommunications wires. Each toggle of a plurality of toggles is independently and pivotally connected to the upper member and includes a through bore for accepting an end of a wire that is accessible to an installer when the toggle is in an open, un-terminated position. Each of the toggles are movable from the open, un-terminated position to a closed, terminated position such that the wire makes an electric contact with one of the pairs of stampings through pivotal movement of the toggle. As the toggle is manipulated with manual force from the open, un-terminated position to the closed, terminated position, the wire is positioned within a channel within the toggle and also forms a substantial U shape to better retain the wire to the toggle. The upper member includes a plurality of apertures through which an end of a test probe is inserted. The end of the test probe is positionable through the aperture and between the pair of stampings such that a signal through the pair of stampings can be monitored or the circuit can be interrupted for testing of either side of the circuit.

DETAILED DESCRIPTION

Figure 1:
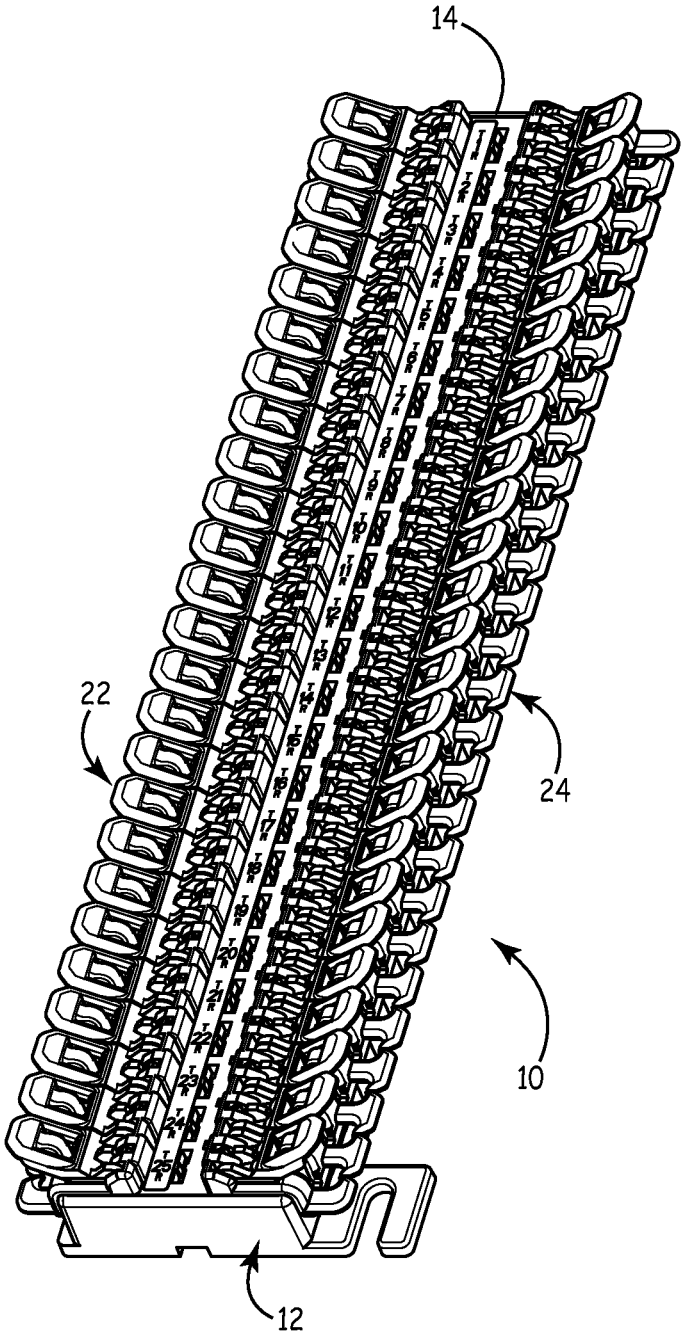
FIG. 1 is a perspective view of a telecommunications wiring termination block.

A telecommunications wiring termination block is generally illustrated in FIG. 1 at 10. The termination block 10 provides improved pair-to-pair wire isolation which improves the transfer of high speed data signals (xDSL) along with voice signals (POTS). Further, the design of the termination block 10 does not require any special tools to install the wiring into the termination block 10. Rather, the termination block 10 and the associated telecommunications wiring can be installed with tools that are typically utilized by all installers such as wire cutters, wire strippers and screwdrivers. As such, the wiring block 10 can be considered to be a "tool-less" termination block because no customized or specialized tools are required to install the telecommunications wiring to the termination block 10, such as a customized punch down tool. A "tool-less" termination block is desirable because tool costs for the installers are minimized because no special tools are required to install the termination block 10.

Figure 2:
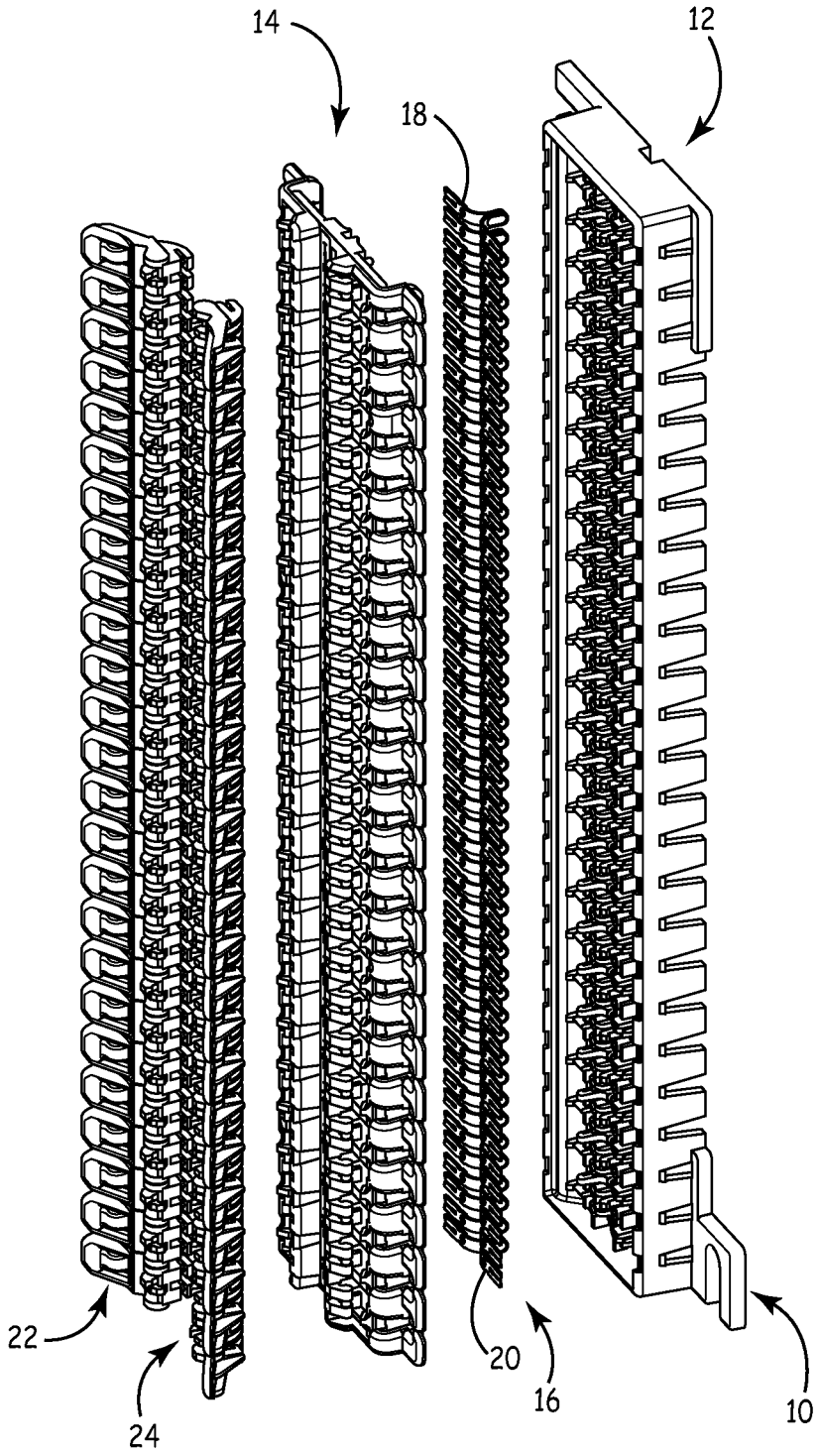
FIG. 2 is an exploded view of the telecommunications wiring termination block.

Referring to FIGS. 1 and 2, the termination block 10 includes a bottom non-conductive member 12 and an upper non-conductive member 14 that retain a plurality of stampings 16 therebetween. The bottom non-conductive member 12 and the upper non-conductive member 14 are typically plastic, molded pieces that are secured together with a snap fit to retain the members 12 and 14 together and the stampings 16 therebetween. However, other securing mechanisms besides a snap fit are also contemplated.

The pairs of stampings 16 include left and right rows of stampings 18 and 20, respectively, where opposing stampings 16 in the left and right rows 18 and 20 are positioned into conductive contact such that a circuit is completed when the exterior telecommunications wiring and the internal telecommunications wiring are each terminated to one of the opposing stampings 16 in the rows 18 and 20, respectively. Each stamping 16 in the left and right rows 18 and 20 are designed to make conductive contact with a corresponding end of a wire though manipulation of a corresponding left or right toggle 22 and 24, respectively, that are pivotally attached to the upper non-conductive member 14.

There are typically fifty left stampings 18 on the left side of the block 10 and fifty right stampings 20 on the right side of the block 10. The fifty stampings 18 and 20 on each side of the block 10 are group into pairs.

The stampings 16 are typically formed from a conductive metal. However, a stamping formed of two or more materials is also contemplated as long a circuit can be completed between the stampings.

For each pair of the left and right stampings 18 and 20 there is a corresponding toggle 22 and 24, respectively, that accepts a pair of wires. The toggles 22 and 24 have the same construction and are constructed from a non-conductive material, such as a plastic, where the toggles 22 and 24 are molded into the selected form. Therefore a typical termination block 10 includes twenty five left toggles 22 and twenty five right toggles 24. However, different numbers of stampings 16 and toggles 22, 24 besides fifty stampings and twenty five toggles are also contemplated.

Figure 3:
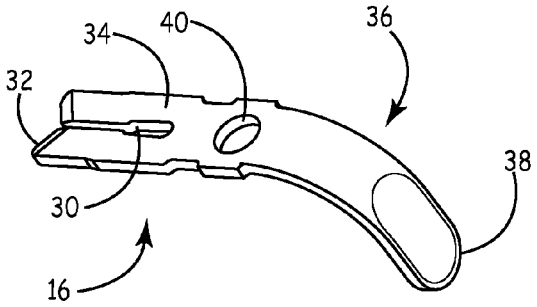
FIG. 3 is a perspective view of a stamping for forming an electric connection.
Figure 4:
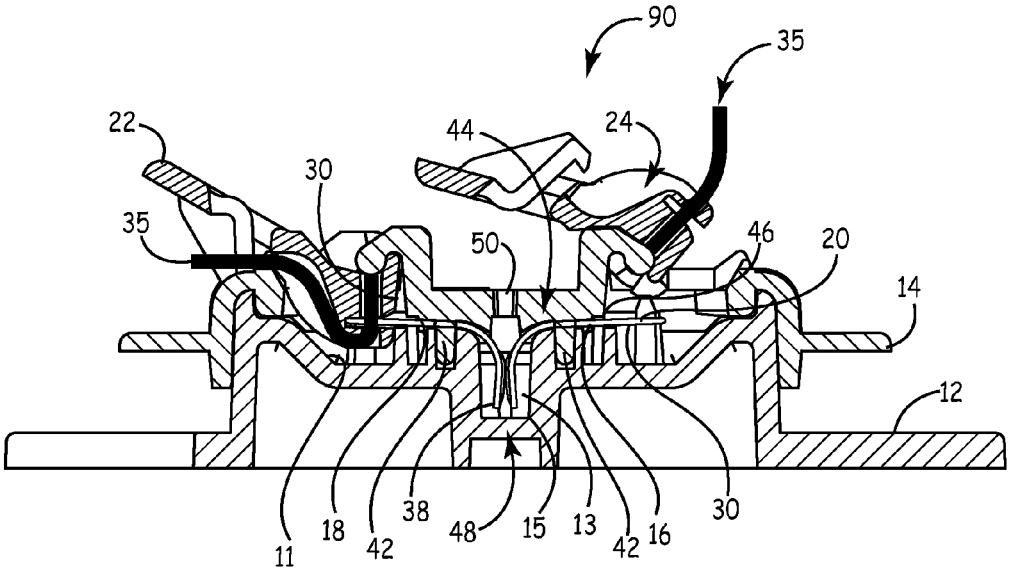
FIG. 4 is a section and schematic view of the telecommunications wiring termination block showing a left side in a closed, terminated position and a right side in an open, un-terminated position.
Figure 5:
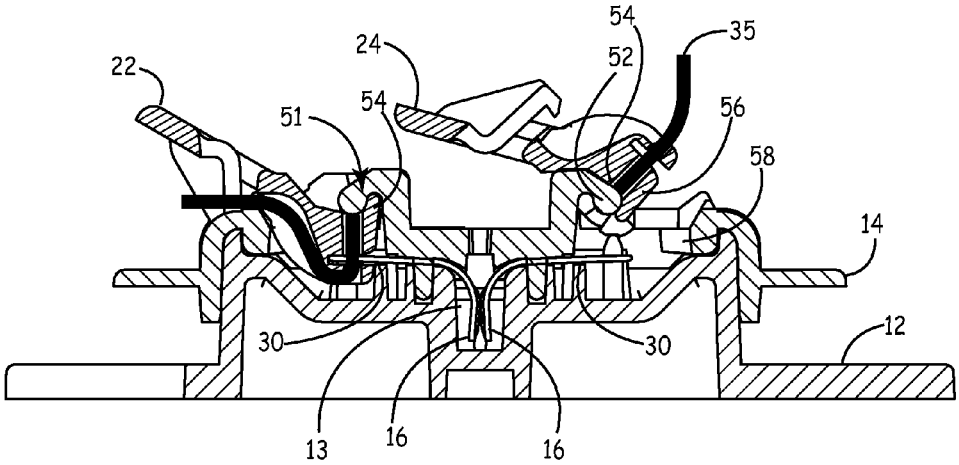
FIG. 5 is another sectional view of the telecommunications wiring termination block showing a left side in a closed, terminated position and a right side in an open, un-terminated position.
Figure 6:
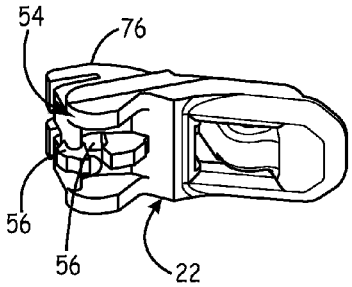
FIG. 6 is a first perspective view of a toggle for the telecommunications wiring termination block.
Figure 7:
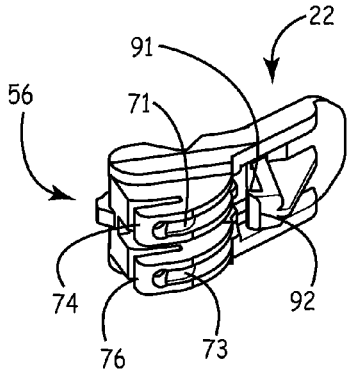
FIG. 7 is a second perspective view of the toggle for the telecommunications wiring termination block.
Figure 8:
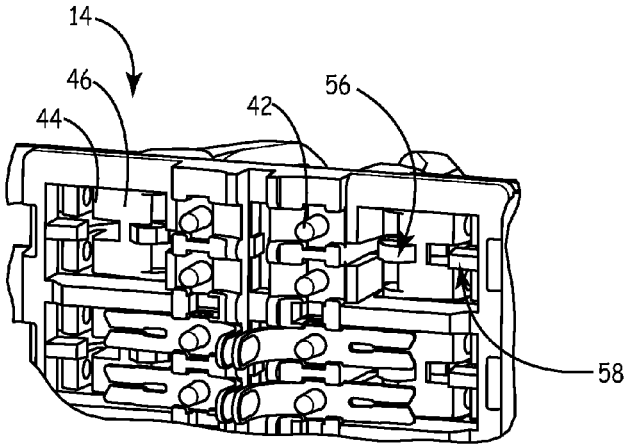
FIG. 8 is a partial perspective view from a bottom view of an upper member of the telecommunications wiring termination block.

Referring to FIGS. 3 and 4, each metal stamping 16 in the rows of stampings 18 and 20 has the same construction. Each stamping 16 has a slot 30 at a proximal end 32 for engaging and making conductive contact with an end of a wire 35. The slot 30 is within a substantially flat and horizontal portion 34 of the stamping 16. The stamping 16 includes to a curved contact portion 36 that transitions the flat horizontal portion 34 to an arcuate, downwardly configured distal end 38.

The contact portion 36 typically includes an embossed feature, typically a cylindrical feature, to aid in providing flexibility and increase the conductive contact between two contact portions 36 of two stampings 16. However, the embossed feature is an optional feature.

Each stamping 16 includes a mounting hole 40 for locating the stamping 16 onto a separate tapered pin 42 extending from a bottom surface 44 of the upper member 14. The bottom surface 44 of the upper member 14 includes a plurality of recessed areas 46 where each recessed area 46 closely matches or cooperates with a portion of the horizontal portion 34 of the stampings 16 such that each stamping 16 fits or nests into one of the recessed areas 46. However, the stampings 16 will not completely nest into the recessed areas 46 until the lower member 12 and the upper member 14 are assembled together, typically through a snap fit. Once assembled, the stampings 16 are forced into contact with the bottom surface 44 in the recessed area of the upper member 14, resulting in pressure being placed upon the opposing stampings 16 in the left and right rows 18 and 20 at a contact plane 48 across each stamping 16. Once the upper member 14 and the lower member 12 are fit together, the downwardly extending portion 38 of the pair of stampings 16 extend into a cavity 13 in the lower member 12 to aid in retaining the pairs of stampings 16 in the selected position and to assist in applying pressure to the stampings 16 at the contact plane 48. When the stampings 16, upper plastic member 14, and lower plastic member 12 are fully assembled, the flat portion 34 of the stampings 16 is approximately parallel and offset a distance from a top surface 11 of the lower member 12.

With the block 10 assembled, the contact portion 38 of the left stamping 18 and the contact portion 38 of the right stamping 20 make contact at the contact plane 48 in the center of the block 10, such that a test probe can be inserted between the contact portions 38 of the left and right stampings 18 and 20, respectively, through an aperture 50 in the upper member 14. When the test probe is positioned between the stampings 16 at the contact plane 48, the electrical connection between the left and right stampings 18 and 20, respectively, can be disconnected or monitored. The design of the block 10 including that of the stamping 16 and the slot 30 along with the toggle does not require a punch down tool to make a connection between the end of the wire 35 and the stamping 16, and can be considered to be a tool-less insulation displacement clip (IDC).

Referring to FIGS. 5-8, the toggles 22 and 24 are of the same construction, and are pivotally secured to the upper member 14 through the cooperation of a left or right rounded protrusion 51 and 52 on the upper member 14 with a rounded, recessed area 54 on the toggles 22 and 24. The toggles 22 and 24 are pivotally secured to the upper portion 14 such that the recessed areas 54 are rotatable about the protrusions 50 and 52 to allow the toggles to be rotated with manual force from the open, un-terminated position to the closed, terminated position.

Figure 10:
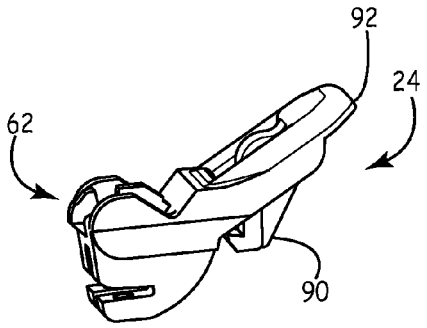
FIG. 10 is a third perspective view of the toggle for the telecommunications wiring termination block.
Figure 9:
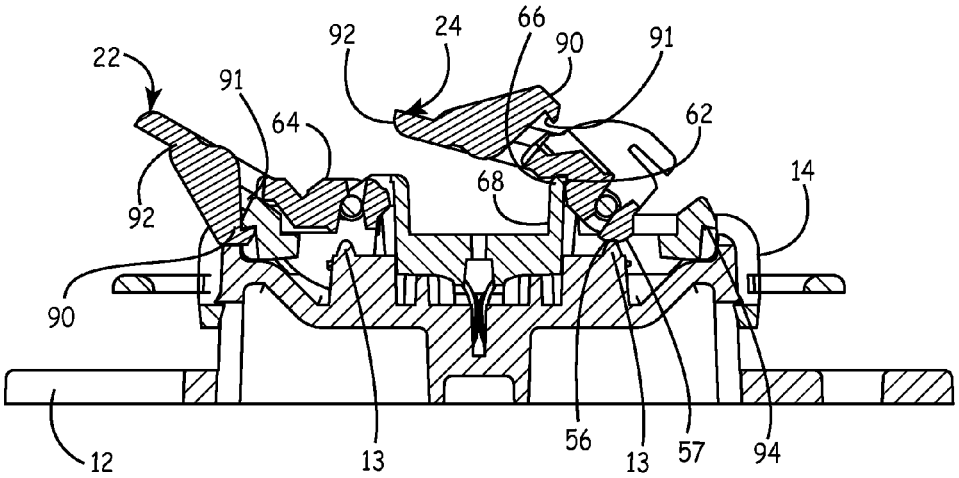
FIG. 9 is a sectional and schematic view of the telecommunications wiring termination block showing a left toggle retained in the closed, terminated position and the right toggle retained in the open, un-terminated position.

Referring to FIGS. 9 and 10, each toggle 22 and 24 includes an indented portion 56 on a rounded top front section 57. The lower member 12 has a protrusion 13 that slightly interferes with the rounded top front section 56 of the toggle 22 or 24 as the toggle 22 or 24 is rotated up to the open un-terminated position. With the toggle in the open, un-terminated position a protrusion 62 on a top side 64 slightly interferes with a bottom surface of a ledge 66 extending from a vertical member of the upper member 14 such that the toggles 22 and 24 are secured in the open un-terminated position, as shown with toggle 24.

Figure 11:
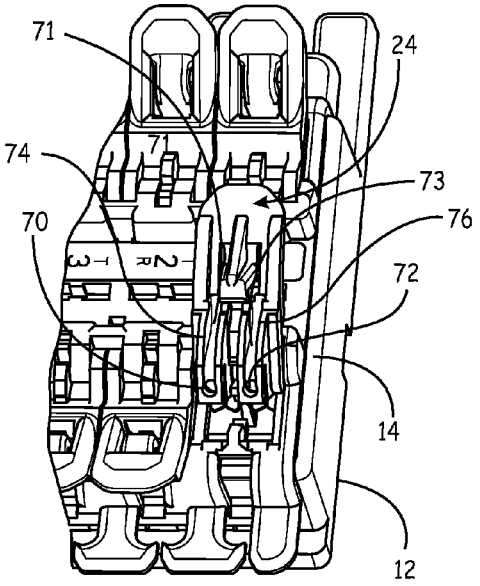
FIG. 11 is a partial perspective view of one toggle in an open, un-terminated position and another toggle in a closed, terminated position.
Figure 12:
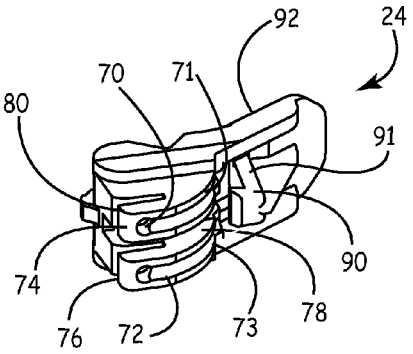
FIG. 12 is a fourth perspective view of the toggle for the telecommunications wiring termination block.

Referring to FIGS. 11 and 12, with the toggle 24 in the open, un-terminated position, two holes 70 and 72 are facing towards the left or the right side of the block 10 for easy access and installation of ends of a pair of telecommunication wires into the toggle 24 by the installer. The holes 70 and 72 extend through bottom legs 74 and 76 and into the main body of the toggle 24 to better retain the ends of the wires therein. The bottom legs 74 and 76 are separated by a vertical channel 78 and a horizontal channel 80. The toggles 22 and 24 include slots 71 and 73 that intersect the holes 70 and 72 where the slots 71 and 73 are perpendicular to the longitudinal axis of the corresponding hole 70 and 72, all respectively.

Referring back to FIGS. 5 and 9, after the toggle 22 or 24 is freed from the ledge 66 that forms the detent and rotated into from the open, un-terminated position toward the closed terminated position, the pair of wires 35 are folded into the slots 71 and 73 and under the toggles. When the toggles are rotated to the closed, terminated position, as illustrated with toggle 22, the horizontal channel 80 in the toggles 22 or 24 fit over the stampings 18 and 20, respectively, thereby terminating the wire 35 into the slot 30 of the flat portion 34 or IDC and making a connection.

The toggles 22 and 24 are secured to the upper member 14 in the closed, terminated position with a flexible latch arm 90 on the lever arm portion 92 on the toggle that includes a ledge 91 that engages a second ledge 94 in the upper member 14 to secure the toggle 22 or 24 in the closed, terminated position through a snap fit between the flexible latch arm 90 and the second ledge 94. To release the toggle 22 or 24 from the closed, terminated position, the flexible latch arm 90 on the toggle 22 or 24 is manually forced downward until the ledge 91 on the flexible latch arm 90 is displaced from the second ledge 94 on the upper member 14. Once the flexible latch arm 90 is displaced from the second ledge 94, the toggle 22 or 24 is rotatable from the closed, terminated position to the open, un-terminated position.

Figure 13:
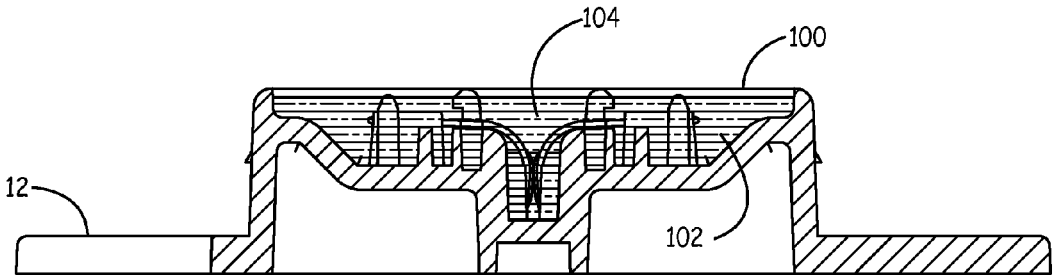
FIG. 13 is a partial sectional view of the bottom member filled with a corrosion preventative compound.

Referring to FIG. 13, the bottom member 12 includes end walls, one of which is illustrated at 100, to form a volume 102 that may be filled with a silicone gel 104. The silicone gel 104 covers the stampings to provide corrosion protection. However, other corrosion protectors may be utilized, and a corrosion protector is not necessary to utilize the termination block 10.

Figure 14:
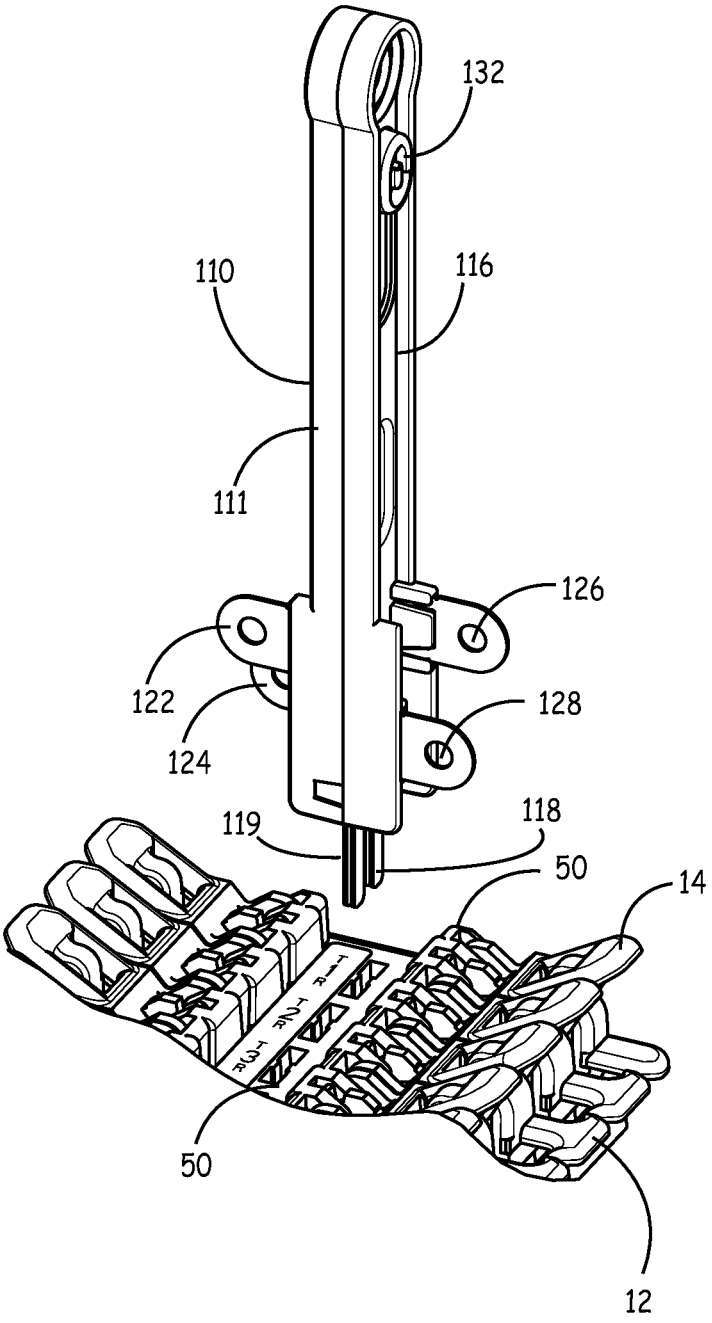
FIG. 14 is a perspective view of the telecommunications block with a test probe positioned above the telecommunications block.
Figure 15:
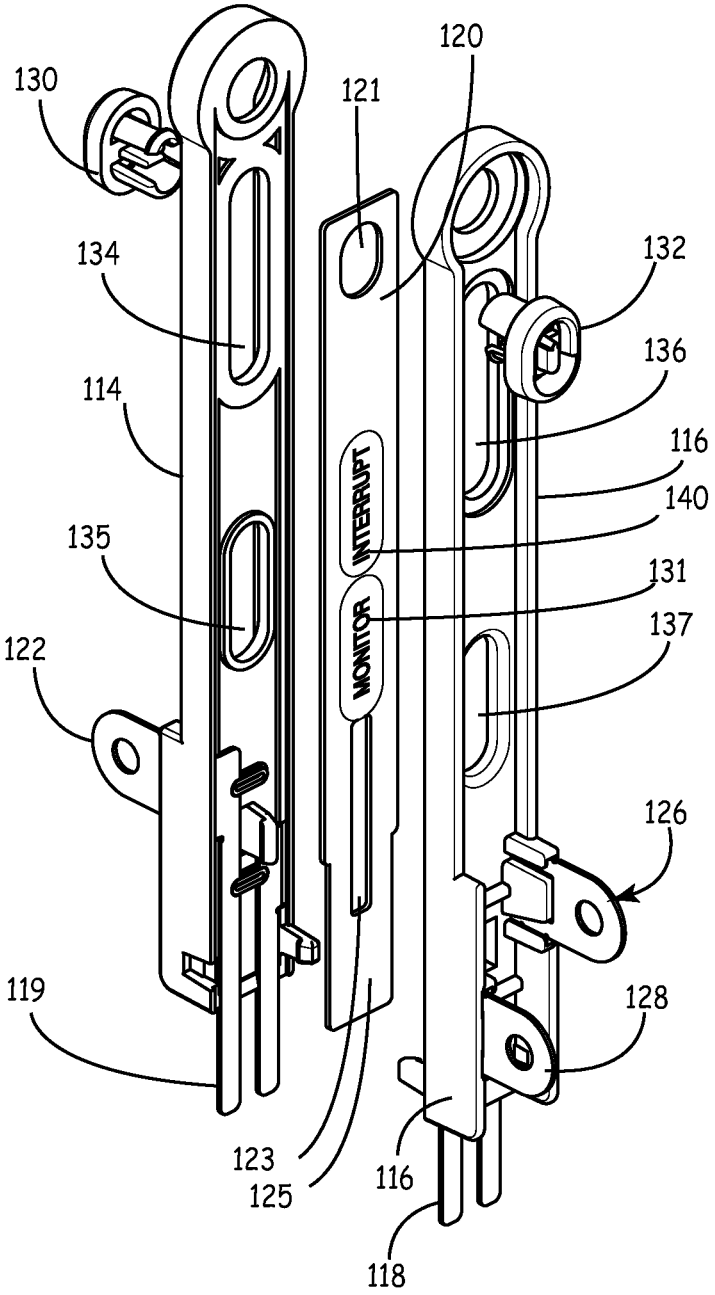
FIG. 15 is an exploded view of the test probe.
Figure 16:
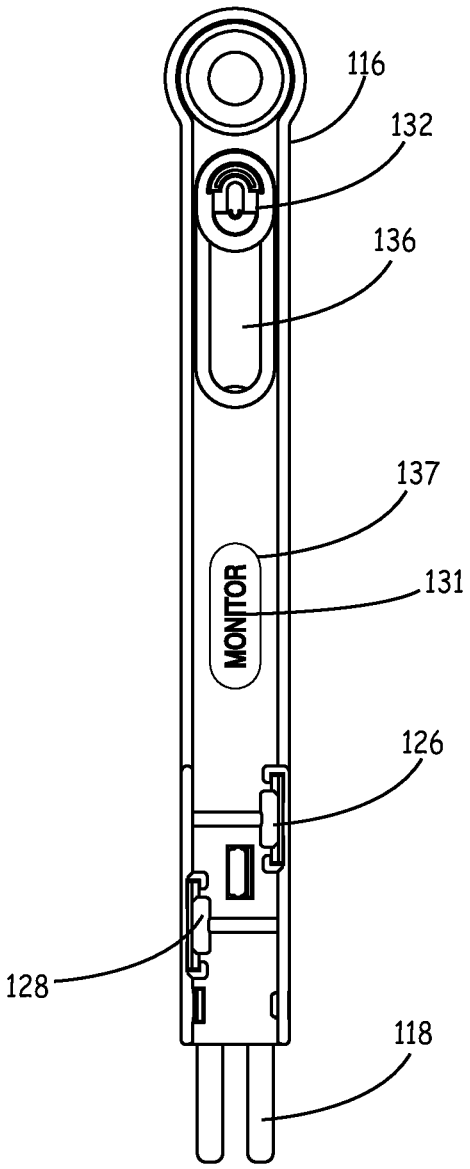
FIG. 16 is a front view of the test probe.

Referring to FIGS. 14-16, metal stampings 118 and 119 of a test probe 110 can be inserted into the opening 50 in the upper member 14 and between the stampings 16 in the left and right rows 18 and 20 to cause the connection to be broken such that the signals through the pairs of stampings 16 can be monitored or diagnostic testing on either the internal wiring pair or external wiring pair can be conducted. The probe 110 includes a left half 114, that is non-conductive and typically plastic, and a right half 116 that is non-conductive and typically plastic, where the halves 114 and 116 are snap fit together.

A non-conductive slide switch 120 is retained between the halves 114 and 116 and is slidably positionable from a monitoring position where the circuit is not interrupted to an interrupting position where the circuit is broken. The switch 120 includes an aperture 121 that accepts left and right retaining portions 130 and 132. The retaining portions 130 and 132 snap fit together and travel within in left and right slots 134 and 136 in the left and right halves 114 and 116, all respectively. The switch 120 also includes an elongated slot 123 that accepts a peg that guides the switch 120 from the monitoring portion to the interrupting position and back.

The left stamping 118 includes contacts 126 and 128 that can be electrically connected to a monitoring device. The right stamping 119 includes contacts 122 and 124 that can also be electrically connected to the monitoring device.

The switch 120 is manipulated with manual force to the monitoring position corresponding to positioning the left and right retaining portions 130 and 132 proximate an upper end of the slots 134 and 136. With the switch 120 in the monitoring position a distal end 125 of the switch 120 is retracted from the stampings 118 and 119, such that the stampings 118 and 119 are in conductive contact and the signal through the stampings 118 and 119 can be monitored. With the switch 120 in the monitoring position an indicator 131 on the switch is visible through a second slot 135 and 137 in the halves 114 and 116, respectively, that indicates that the switch is in the monitoring position.

When manual force is exerted on the retaining portions 130 and 132 the switch 120 is forced downward until the retaining portions 130 and 132 are proximate the lower end of the slots 134 and 136. With the retaining portions 130 and 132 proximate the lower ends of the slots 134 and 136, the distal end of the switch 120 separates the stampings 118 and 119. Because the switch 120 is of a non-conductive material, the circuit between the stampings 118 and 119 is interrupted. When in the interrupted position, a second indicator 140 is visible through the second slots 135 and 137 that indicates that the circuit has been interrupted.

Although the present invention has been described with reference to preferred embodiments, workers skilled in the art will recognize that changes may be made in form and detail without departing from the spirit and scope of the invention.

The invention claimed is:

1. A telecommunications wiring termination block comprising:

a bottom non-conductive member;

a top non-conductive member attached to the bottom non-conductive member;

at least first and second conductive stampings retained between the bottom non-conductive member and the top non-conductive member and wherein the first and second stampings are in conductive contact;

at least a first toggle pivotally attached to the top non-conductive member and having a first slot that intersects a first aperture, the first toggle being configured to accept an end of a first telecommunications wire within the first aperture and wherein as the first toggle is moved from an open, un-terminated position to a closed, terminated position, the wire is positioned within the slot and the slot positions about the first stamping to place the first wire in conductive contact with the first stampings; and at least second toggle pivotally attached to the top non-conductive member and having a second slot that intersects a second aperture, the second toggle being configured to accept an end of a second telecommunications wire within the second aperture and wherein as the second toggle is moved from an open, un-terminated position to a closed, terminated position, the second wire is positioned within the second slot and the second slot is positioned about the second stamping to place the second wire in conductive contact with the second stamping wherein the first and second telecommunications wires are movable into conductive contact with the first and second stampings through manipulation of the first and second toggles and without the need of special or customized tools.

2. The termination block of claim 1 and wherein the first and second stampings comprise:

a flat portion having a slot configured to accept the telecommunications wire; and a downward arcing portion wherein the arcing portions make contact at a contact plane under pressure when the stamping are retained between the top and bottom non-conductive members.

3. The termination block of claim 2 and wherein the downward arcing portion comprises an embossed feature that increases the flexibility of the stampings and assists in making conductive contact at the contact plane.

4. The termination block of claim 2 and wherein the top non-conductive member comprises:

a bottom surface comprising a plurality of pegs extending downwardly therefrom for retaining the stampings; and a cavity having a similar configuration to that of the flat portion of the stampings such that the stampings nest within the cavity when the top and bottom non-conductive members are secured together.

5. The termination block of claim 4 and wherein the stampings further comprise an aperture for accepting one of the pegs extending from the bottom surface of the top non-conductive member.

6. The termination block of claim 1 and wherein the upper portion comprises a slot that aligns with the contact plane such that an end of a probe can be inserted therethrough and between the first and second stampings at the contact plane.

7. The termination block of claim 1 and wherein the first toggle and the second toggle have the same construction and configuration such that the first toggle and the second toggle are interchangeable.

8. The termination block of claim 7 and wherein the first and second toggles each comprise:

a main body that is pivotally attached to the top non-conductive member;

a first leg extending from the main body and wherein the first leg comprises the first aperture and the first slot; and a second leg extending from the main body and spaced apart from the first leg and wherein the second leg comprises a third aperture and a third slot intersecting the third aperture and wherein the first and second legs accept a pair of wires in the first and third apertures such that the pair of wires can be placed into conductive contact with a pair of stampings.

9. The termination block of claim 8 and wherein the first and second toggles further comprise:

an extension protruding from a first end the main body and having an indent therein and wherein the extension engages the top non-conductive member to retain the toggle in the open, un-terminated position; and a latch extending from proximate a second end of the main body and wherein the latch releasably engages the top non-conductive member to retain the toggle in the closed, terminated position.

10. The termination block of claim 8 and wherein the first and second toggles further comprising a handle extending from the main body.

11. A telecommunications wiring termination block comprising:

a bottom non-conductive member;

a top non-conductive member attached to the bottom non-conductive member;

a first row of conductive stampings retained between the bottom non-conductive member and the top non-conductive member;

a second row of conductive stampings retained between the bottom nonconductive member and the top nonconductive member and wherein each stamping in the first row of conductive stampings is in conductive contact one stamping in the second row of conductive stampings wherein the stamping in the first row and the stampings in the second row are similarly constructed;

a first row of toggles wherein each of the toggles in the first row of toggles are similarly constructed and each toggle is pivotally attached to the top non-conductive member, wherein each toggle in the first row of toggles includes a first slot that intersects a first aperture and a second slot that intersects a second aperture wherein the first and second aperture and slots are spaced apart from each other, the toggles in the first row of toggles being configured to accept ends of a first pair of wires of a first twisted pair telecommunications wires within the first and second apertures and wherein as the first toggle is moved from an open, un-terminated position to a closed, terminated position, the wires are positioned within the first and second slots and the slots position the pair of wires in conductive contact with separate stampings in the first row of stampings; and a second row of toggles pivotally attached to the top non-conductive member and spaced apart for the first row of toggles, the second row of toggles having the same construction as the first row of toggles, wherein each toggle of the second row of toggles is pivotally attached to the top non-conductive member and wherein each toggle in the second row of toggles includes a first slot that intersects a first aperture and a second slot that intersects a second aperture wherein the first and second aperture and slots are spaced apart from each other, the toggles in the second row of toggles being configured to accept ends of a second pair of wires of a second twisted pair telecommunications wire within the first and second apertures and wherein as the toggles in the second row of toggles are moved from an open, un-terminated position to a closed, terminated position, the second pair of wires are positioned within the first and second slots and the slots position the pair of wires in conductive contact with separate stampings in the second row of stampings wherein the first and second twisted pair telecommunications wires are movable into conductive contact with the first and second stampings through manipulation of the first and second toggles and without the need of special or customized tools.

12. The termination block of claim 11 and wherein each stamping in the first and second row of stampings comprise:

a flat portion having a slot configured to accept the telecommunications wire; and a downward arcing portion wherein the arcing portions make contact at a contact plane under pressure when the stamping are retained between the top and bottom non-conductive members.

13. The termination block of claim 12 and wherein the downward arcing portion comprises an embossed feature that increases the flexibility of the stampings and assists in making conductive contact at the contact plane.

14. The termination block of claim 12 and wherein the top non-conductive member comprises:

a bottom surface comprising a first and second rows of pegs extending downwardly therefrom for retaining the first and second rows of stampings; and first and second rows of cavity having a similar configuration to that of the flat portion of the stampings such that each stamping of the first and second rows of stampings nest within one cavity of the first and second rows of cavities when the top and bottom non-conductive members are secured together.

15. The termination block of claim 14 and wherein the stampings further comprise an aperture for accepting one of the pegs extending from the bottom surface of the top non-conductive member.

16. The termination block of claim 11 and wherein the upper portion comprises a slot that aligns with the contact plane such that an end of a probe can be inserted therethrough and between the first and second stampings at the contact point.

17. The termination block of claim 16 and further comprising a probe configured to be inserted through the slot in the top non-conductive member and wherein the probe comprises first and second probe stampings that are configured to make contact with two of the stampings in the first and second rows of stampings respectively, and wherein the probe is configured to monitor a signal through the first and second probe stampings or the probe is configured to separate the first and second probe stampings.

18. The termination block of claim 11 and wherein the toggles in the first and second row of toggles each comprise:

a main body that is pivotally attached to the top non-conductive member;

a first leg extending from the main body and wherein the first leg comprises the first aperture and the first slot; and a second leg extending from the main body and spaced apart from the first leg and wherein the second leg comprises the second aperture and the second slot intersecting the second aperture and wherein the first and second legs accept a pair of wires in the first and second apertures such that the pair of wires can be placed into conductive contact with a pair of stampings.

19. The termination block of claim 18 and wherein the first and second toggles further comprise:

an extension protruding from a first end the main body and having an indent therein and wherein the extension engages the top non-conductive member to retain the toggle in the open, un-terminated position; and a latch extending from proximate a second end of the main body and wherein the latch releasably engages the top non-conductive member to retain the toggle in the closed, terminated position.

20. The termination block of claim 18 and further comprising a handle extending from the main body.

* * * * *